US005429352A

United States Patent [19]

Leclerc

[11] Patent Number: 5,429,352

[45] Date of Patent: Jul. 4, 1995

[54] HOCKEY BLADE

[75] Inventor: Richard D. Leclerc, Westminster, Mass.

[73] Assignee: Mylec, Inc., Winchendon Springs, Mass.

[21] Appl. No.: 193,625

[22] Filed: Feb. 8, 1994

Related U.S. Application Data

[63] Continuation of Ser. No. 969,092, Oct. 30, 1992, abandoned.

[51] Int. Cl.[6] ..... A63B 59/14

[52] U.S. Cl. ..... 273/67 A

[58] Field of Search ..... 273/67 A, 67 R, 72 R, 273/72 A, 167 R, 167 E, 73 G, 73 C

[56] References Cited

U.S. PATENT DOCUMENTS

| | | | |
|---|---|---|---|
| D. 237,636 | 11/1975 | Leclerc | 273/67 A |
| D. 244,790 | 6/1977 | Carlson | 273/67 A |
| 3,561,760 | 2/1971 | Klay | 273/67 A |
| 4,013,288 | 3/1977 | Goverde | 273/67 A |
| 4,076,240 | 2/1978 | Haddad | 273/67 A |
| 4,340,224 | 7/1982 | Staats | 273/67 A |
| 4,651,990 | 3/1987 | Profit | 273/67 A |

FOREIGN PATENT DOCUMENTS

| | | | |
|---|---|---|---|
| 108623 | 9/1943 | Sweden | 273/67 A |
| 1383949 | 2/1975 | United Kingdom | 273/67 A |

*Primary Examiner*—Mark S. Graham

*Attorney, Agent, or Firm*—Hayes, Soloway, Hennessey, Grossman & Hage

[57] ABSTRACT

A hockey blade is provided with a plurality of slots spaced along its longitudinal mid-line and extending transverse to that mid-line at various angles.

27 Claims, 3 Drawing Sheets

HOCKEY BLADE

This is a continuation of application Ser. No. 07/969,092 filed on Oct. 30, 1992, now abandoned.

TECHNICAL FIELD

This invention relates to hockey blades, and more particularly to such blades that have slots in them arranged vertically along their longitudinal axis to affect ball control.

BACKGROUND ART

This invention relates most particularly to the art of street hockey in which a ball or puck contacts a wooden or plastic blade and generally bounces off.

Its been desirable in this art to provide blades for the hockey sticks which cut down on wind resistance. Such a blade is shown in U.S. Design Patent No. 237,636 issued to Raymond W. Leclerc Nov. 11, 1975 which shows a plurality of oval shaped openings in the blade. The ovals are close to the upper edge of the blade, have their longitudinal axes parallel to the longitudinal axis of the blade and decrease in size from the toe to the heel. While these openings do decrease air resistance, their positioning and shape are not in the strike zone on the blade and thus the ball or puck would not normally contact the area of the blade having the openings in it.

Another structure as disclosed in U.S. Pat. No. 4,076,240 issued to Daniel G. Haddad, Feb. 28, 1978 shows a blade formed in a honeycomb/like matrix with various curvatures. It is stated that this not only reduces air resistance, but also imparts to the puck "english" in both the horizontal and vertical directions. As disclosed therein the honeycomb matrix is formed from a plurality of interconnecting plates oriented either perpendicular or parallel to the length of the blade. Each plate has a portion of greatest thickness, a width, and a length; the greatest thickness being substantially less than the width. The length and the greatest thickness are oriented generally parallel to the contact surface.

In addition, in the prior art there are numerous blades with flat surfaces. Flat surfaces tend to make the ball bounce away so that the player does not have great control over it.

It is desirable to have the blade designed such that it allows a player to trap the ball and hold the ball on the stick while running or maneuvering.

DISCLOSURE OF THE INVENTION

I have found that by including a plurality of longitudinally spaced slots along the longitudinal axis of the blade when viewed from the side, with each of the slots having the longer axis at an angle to the longitudinal axis of the blade, I can achieve many of the advantages of ball control desirable in this sport. In particular I found that this blade is useful in trapping the ball (i.e., it allows the player to hold the ball on the blade when receiving a pass from a team mate). Furthermore, spin can be provided by arranging the slots in certain ways and a rise can be put on the ball by arranging the slots in certain ways.

Accordingly, it is an object of my invention to provide a hockey blade which has improved ball control qualities from those blades known in the prior art. This and other objects of my invention will become apparent from the following description with reference to the accompanying drawings.

DESCRIPTION OF THE PREFERRED EMBODIMENTS

Figure 4:
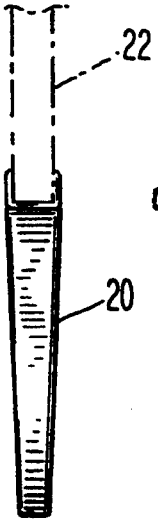
FIG. 4 is a rear view of the hockey blade shown in FIG. 1.
Figure 3:
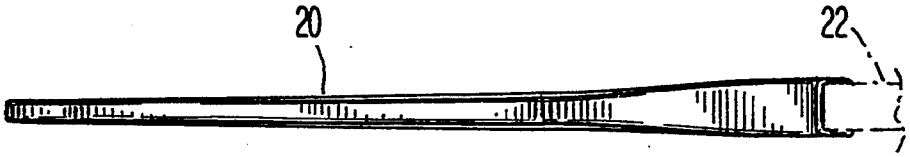
FIG. 3 is a top view of the hockey blade shown in FIG. 1.

The preferred embodiment of my invention may best be understood with references to FIGS. 1 through 5 wherein it will be noted that the blade 20 is shown extending from the lower end of a hockey stick handle 22. It will be understood that the handle is shown in dotted lines to show the environment in which the blade is mounted to the handle, as for example, a replacement blade. In accordance with my invention, the blade could be integral with the hockey stick that is the blade and the handle could be one piece. The materials for the blade and or the handle may be made of wood or thermo-plastics including, by way of example and not by way of limitation, polystyrene, high density polyethylene, ABS, Lexan, Zytel, etc..

Further, in accordance with the preferred embodiment of my invention the surface of the material may be sandblasted to provide a rough finish.

The current regulation maximum size a hockey blade is 12 ½ inches long from the toe to the heel and cannot exceed three inches in width. In my preferred embodiment the blade size is 11 ½ inches long and three inches wide at its widest point near the toe designated generally 24. As will be understood by those in the art, the heel is that area designated 26.

Figure 1:
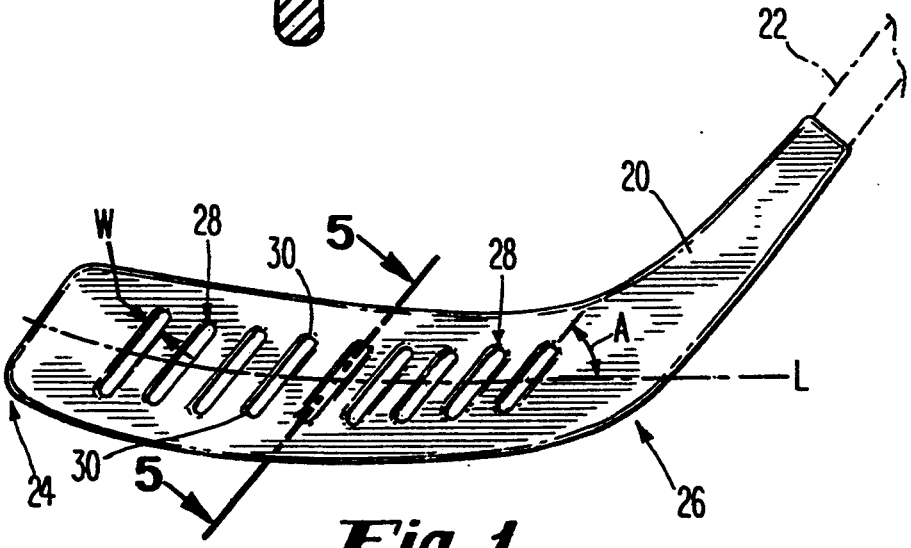
FIG. 1 is a side view of hockey blade in accordance with my invention.

A plurality of slots are provided along the longitudinal mid-line axis L shown in FIG. 1. Note that a hockey blade is irregular in shape, thus the axis L may vary from the horizontal depending on that shape, so that it is not a straight line. However, when used in this description and in the claims, those of ordinary skill in the art will understand that the longitudinal axis is taken generally as shown as the mid-line L in FIG. 1.

Figure 5:
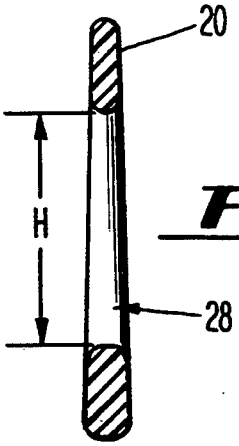
FIG. 5 is an enlarged sectional view taken as indicted by the lines and arrows 5—5 in FIG. 1.
Figure 2:
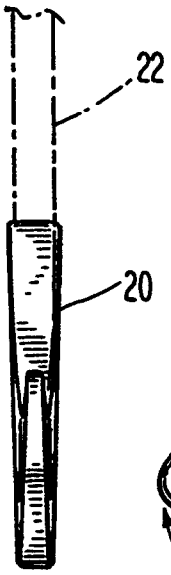
FIG. 2 is a front view of the hockey blade shown in FIG. 1.

A plurality of slots is provided (designated generally 28), one of which is shown by the sectional view taken along the lines 5—5 in FIG. 1 and disclosed in greater detail enlarged in FIG. 5. Note therein the taper of the blade from the bottom surface to the top surface.

The surfaces of the blade which form the slots are preferably rounded as shown in FIG. 5 and the vertical edges forming the slots are joined by curved surfaces as shown at 30 FIG. 1.

In the preferred embodiment shown in FIG. 1, all of the slots are at an acute angle to the mid-line or longitudinal axis L; that is, the angle between the longer axis of the slot and the mid-line L is greater than zero, but less than 90 degrees; that angle being shown as typically the angle A in FIG. 1.

In this configuration the blade imparts resistance to the ball rising when it is released. The predominant feature of this and all the other embodiments is that the ball tends to stay on the blade longer giving the player more control. I have found the preferred embodiment to be nine slots which are ¼ inch in width W and 2 to 1 9/16 inches in height (shown as H in FIG. 5) from the toe to heel. However, slots may vary from one quarter inch to one half inch in width and one to two and half inches in height.

In the embodiment shown in FIG. 1, the plurality of slots varies in length from one slot to another, the smaller slots being closer to the heel, but all of the slots have substantially the same acute angle to the mid-line of the blade.

Figure 6:
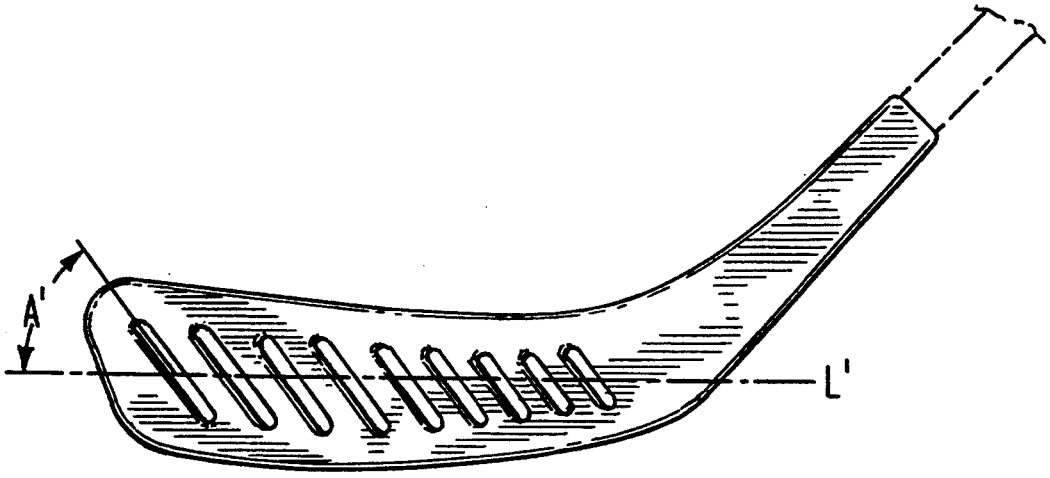
FIG. 6 is a side view of alternate embodiment of my invention in a hockey blade.

Another embodiment of my invention is shown in FIG. 6 wherein the slots are the same size as those in FIG. 1, but are at an obtuse angle to the mid-line L'; that is, the angle shown illustratively and designated A' is greater than 90 but less than 180 degrees to the mid-line. In this embodiment, the configuration encourages a rise on the ball when it is released from the blade.

The choice of blade style is a matter of player preference. Depending on which blade is used, the shooter can put a rise on the shots or keep the shots low.

Figure 7:
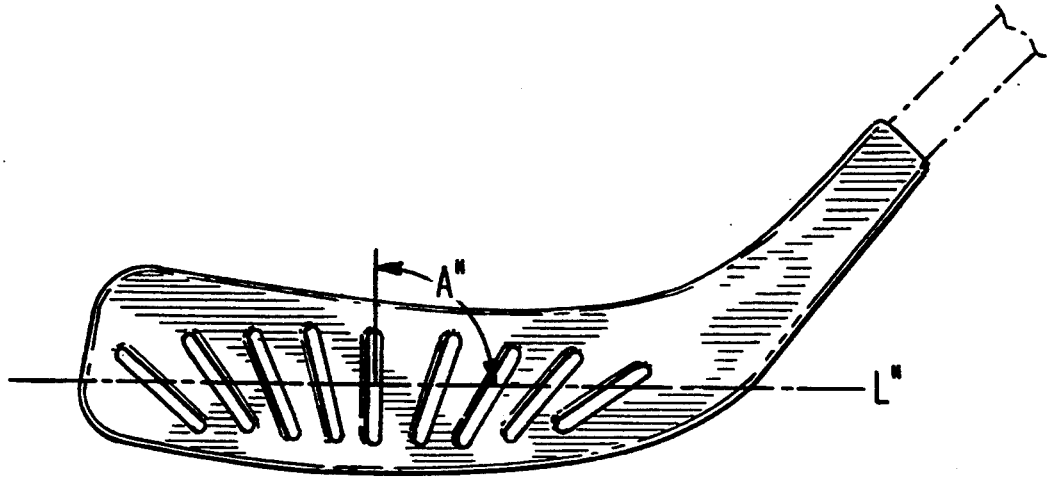
FIG. 7 is a side view of another alternate embodiment of my invention in a hockey blade.

The embodiment shown in FIG. 7, provides for both characteristics in that those slots closer to the heel of the blade are oriented at acute angles and those closer to the toe are oriented at obtuse angles. This embodiment also shows at least one slot being vertical or right angles (i.e. 90 degrees) to the mid-line L" as shown by the angle designated A". A further feature is that the slots are not uniformly angled, but are varied in a fan fashion, such that the angles increase from heel to toe.

I have also provided in this embodiment, a blunt nose on the toe which is substantially perpendicular to the mid-line. In this embodiment a player may trap the ball and release it from the heal for a low shot or from the toe for a shot on the rise.

Figure 8:
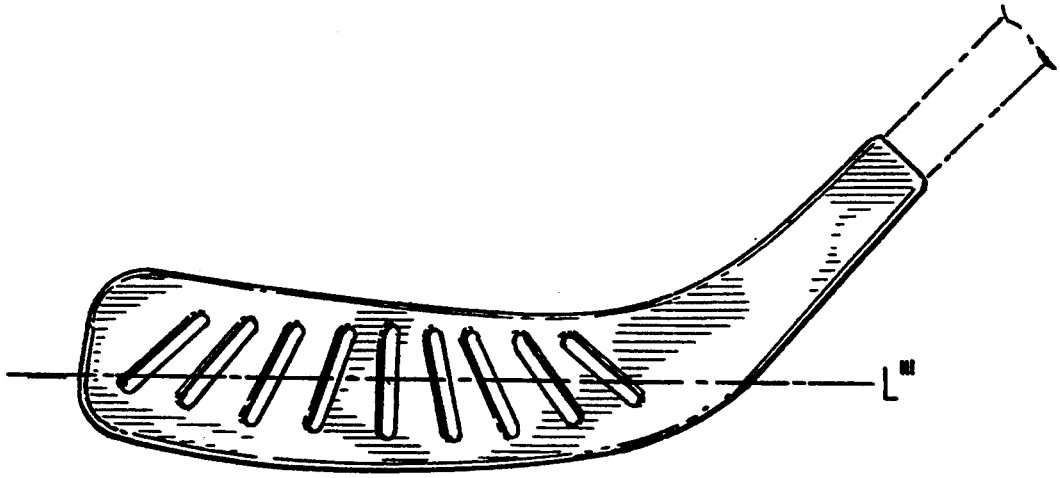
FIG. 8 is a side view of another alternate embodiment of my invention in a hockey blade.

Another embodiment is shown in FIG. 8 in which the slots are arranged in a fan fashion with a plurality of obtuse angles/closer to the mid-line L''' to the heal and a plurality of acute angles closer to the toe. When the player traps the ball in the blade, it can be released for a low shot from the front of the blade or a shot on the rise from the rear of the blade.

Figure 9:
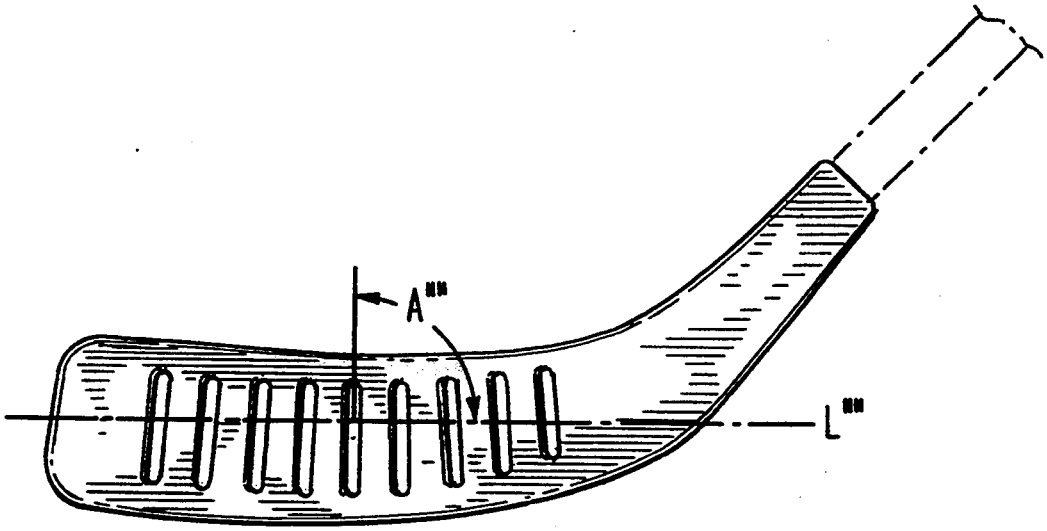
FIG. 9 is a side view of another alternate embodiment of my invention in a hockey blade.

FIG. 9 shows slots which are straight up and down that is at right angles or substantially 90 degrees to the mid-line L'''' as shown by the angle designated A''''. When the slots are straight up and down, the shooting is "neutral" and will not cause the flight of the ball to rise or stay low. It will still have the features identified in connection with FIGS. 1 through 5, that is it will hold the ball on the blade when receiving a pass from a team mate, thereby allowing the player to trap the ball; it will hold the ball on the blade on the stick while running or maneuvering; when shooting, the slots in the blade will put a spin on the ball causing the ball to curve in flight; there will be less air resistance to stick handling of the ball; and there will be less air resistance for accelerated speed when making a slap shot. It will be understood that the slots in the blade reduce the mass and thereby reduce the weight of the blade making it easier to maneuver in stick handling and passing and still remain within the size limitations of the rules.

In the Figures, reverse side views are identical to the side views displayed. Rear and bottom views are essentially the same in all cases, given the limitations of patent drawings, as are top and front views which would appear the same even though, as will be apparent from the side views, there is a slight variation in taper.

Figure 10:
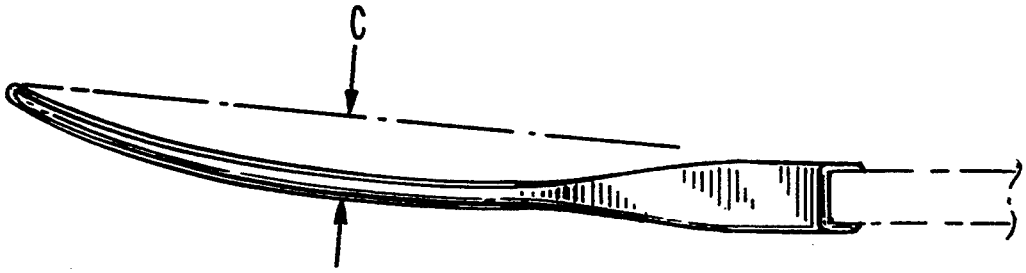
FIG. 10 is a top view of another alternate embodiment of my invention in a hockey blade.

The curved blade shown in FIG. 10 is applicable to all of the embodiments shown in FIGS. 1,6,7,8,& 9 and such curve can be applied from the tip to the heel to present the opposite concavity to that shown in FIG. 10, that is, to curve in the opposite direction. In any event, this curve is to have a concavity no greater than ½ inch maximum as shown by the dimension arrows C in FIG. 10.

The blade may be straight or curved to accommodate both left and right handed shooters.

While the current dimensions have been given, the blade can be made larger of smaller to suit different age groups.

While curves and straight sides have been known in the prior art, I have found that by providing the elongated slots in the blade at a number of various angles and configurations transverse to the mid-line helps hold the ball on the blade in stick handling and receiving a pass, creates more spin on the ball when shooting making the ball curve in flight, helps control the height of the ball while shooting particularly with respect to the embodiment shown in FIGS. 1 through 5, and reduces the mass for lighter weight and less wind resistance to a much higher degree than the design shown in U.S. Pat. No. 237,636.

While the dimensions of the slots may vary it should be apparent that if the slots were so wide as to capture or wedge the ball, this would not be desirable. Furthermore they should not be so dimensioned as to allow the blades of opponents to interlock with each other.

I claim:

1. A hockey blade having a playing surface and a back surface for use as a portion of a hockey stick, comprising:

a plurality of elongated slots extending completely through the blade between the playing surface and the back surface and spaced along and traverse to the longitudinal midline of the blade, and where the angle of some of the slots to the longitudinal mid-line of the blade is acute.

2. The invention of claim 1 wherein the slots vary in length from slot to slot along their longest axis.

3. The invention of claim 2 wherein the variation in length increases from the heel to the toe of the blade.

4. The invention of claim 1 wherein at least one of the surfaces of the blade is rough as a result of having been sandblasted.

5. The invention of claim 1 wherein the blade is curved from toe to heel when viewed along the longitudinal axis from above.

6. The invention of claim 1 wherein the toe of the blade is blunt and at an angle of approximately 90 degrees to the longitudinal mid-line of the blade.

7. The invention of the claim 1 wherein the slot size is in the range of from approximately one quarter to approximately one half inches in width.

8. The invention of claim 1 wherein the slot size is in the range of from approximately one to approximately two and one half inches in height along its longest axis.

9. The invention of claim 1 wherein the structure of the blade surface which forms the slots is curved from side to side when viewed in section.

10. The invention of claim 1 wherein the surface of the blade which forms the slots are rounded between the longitudinal sides of the slots when viewed in plan view.

11. The invention of claim 1 wherein the blade is curved.

12. A hockey blade having a playing surface and a back surface for use as a portion of a hockey stick, comprising:

a plurality of elongated slots extending completely through the blade between the playing surface and the back surface and spaced along and traverse to the longitudinal mid-line of the blade, where the angle of some of the slots to the longitudinal mid-line of the blade is obtuse.

13. A hockey blade for use as a portion of a hockey stick, comprising:

a plurality of elongated slots spaced along and transverse to the longitudinal mid-line of the blade, and wherein the angle of some of the slots to the longitudinal mid-line of the blade is obtuse and the angle of some of the slots to the longitudinal mid-line of the blade is acute.

14. The invention of claim 13 wherein at least one of the slots is substantially at right angles to the longitudinal mid-line of the blade.

15. The invention of claim 13 wherein the slots at an acute angle are closer to the heel then are other slots.

16. The invention of claim 13 wherein the slots at an obtuse angle are closer to the heel of the blade than are the other slots.

17. The invention of claim 13 wherein at least one of the slots is substantially perpendicular to the longitudinal mid-line of the blade.

18. The invention of claim 13 wherein the slots vary in length from slot to slot along their longest axis.

19. The invention of claim 18 wherein the variation in length increases from the heel to the toe of the blade.

20. The invention of claim 13 wherein the blade has a blade surface and the surface of the blade is rough as a result of having been sandblasted.

21. The invention of claim 13 wherein the blade is curved from toe to heel when viewed along the longitudinal axis from above.

22. The invention of claim 13 wherein the toe of the blade is blunt and at an angle of approximately 90 degrees to the longitudinal mid-line of the blade.

23. The invention of claim 13 wherein the slot size is in the range of from approximately one quarter to approximately one half inches in width.

24. The invention of claim 13 wherein the slot size is in the range of from approximately one to approximately two and one half inches in height along its longest axis.

25. The invention of claim 13 wherein the blade has a blade surface and structure and the structure of the blade surface which forms the slots is curved from side to side when viewed in section.

26. The invention of claim 13 wherein the blade has a blade surface and the surface of the blade which forms the slots is rounded between the longitudinal sides of the slots when viewed in plan view.

27. The invention of claim 13 wherein the blade is curved.

* * * * *